US007135091B2

(12) United States Patent
Huhtala et al.

(10) Patent No.: US 7,135,091 B2
(45) Date of Patent: Nov. 14, 2006

(54) ARRANGEMENT FOR THREADING OF WEB IN A PULP MACHINE

(75) Inventors: Olli Huhtala, Littoinen (FI); Tapani Tilli, Raisio (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/474,575

(22) PCT Filed: Jun. 12, 2002

(86) PCT No.: PCT/FI02/00510

§ 371 (c)(1),
(2), (4) Date: Mar. 2, 2004

(87) PCT Pub. No.: WO03/002815

PCT Pub. Date: Jan. 9, 2003

(65) Prior Publication Data

US 2004/0129397 A1 Jul. 8, 2004

(30) Foreign Application Priority Data

Jun. 27, 2001 (FI) ..... 20011372

(51) Int. Cl.
*D21F 1/36* (2006.01)

(52) U.S. Cl. ..... 162/193; 162/255; 162/194; 162/286; 162/363; 34/117; 34/120; 226/7; 226/91; 226/92; 226/95

(58) Field of Classification Search ..... 162/193, 162/255, 286, 363, 194; 34/117, 120; 226/7, 226/91, 92, 95
See application file for complete search history.

(56) References Cited

U.S. PATENT DOCUMENTS

| | | | | |
|---|---|---|---|---|
| 4,136,808 | A * | 1/1979 | Reba | 226/7 |
| 6,073,825 | A * | 6/2000 | Hilker | 226/91 |
| 6,253,983 | B1 * | 7/2001 | Dadd | 226/95 |
| 6,387,220 | B1 * | 5/2002 | Mohrsen et al. | 162/363 |

FOREIGN PATENT DOCUMENTS

| | | |
|---|---|---|
| CA | 972387 | 8/1975 |
| FI | 104840 | 4/2000 |
| FI | 105218 | 6/2000 |
| FI | 106475 | 2/2001 |
| FI | 20001343 | 9/2001 |
| WO | WO 99/39049 | 8/1999 |

OTHER PUBLICATIONS

Copy of International Search Report for PCT/FI02/00510 completed Oct. 17, 2002.

* cited by examiner

*Primary Examiner*—Mark Halpern
(74) *Attorney, Agent, or Firm*—Alston & Bird LLP

(57) ABSTRACT

The invention relates to an arrangement for threading a pulp web (W) from the press section (1) of a pulp machine to the dryer (2) of the pulp machine. The arrangement comprises a closing tail threading belt (3) or the like, which is arranged to convey the narrow tail end ($W_h$) formed on the pulp web (W) inside the dryer (2), where the tail threading cord travels outside the edge of the normal web line of the pulp web. The tail end ($W_h$) can subsequently be broadened into a normal-width pulp web (W). The arrangement further comprises means (7) for gripping the tail end ($W_h$) in order to bring the tail end inside/between a closing tail threading cord (3) or the like, whereby the gripping means (7) are arranged to function at the normal running speed of the pulp machine. The arrangement comprises means (4) by which the tail threading cord (3) can be moved inwards from its normal route, towards the pulp web, to travel essentially in the same line with the tail end formed on the edge of the pulp web before the tail end is conveyed inside the tail threading cord, and means (5) by which the tail threading cord (3) and the tail end ($W_h$) inside it can be moved back to the normal route located outside the edge of the pulp web before entering the dryer (2).

7 Claims, 3 Drawing Sheets

ARRANGEMENT FOR THREADING OF WEB IN A PULP MACHINE

This application is a 371 of PCT/FI02/00510 filed 12 Jun. 2002.

BACKGROUND OF THE INVENTION

1) Field of the Invention

The present invention relates to an arrangement for threading a pulp web from the press section of a pulp machine to the dryer of the pulp machine, the arrangement comprising a closing tail threading belt or the like, which is arranged to convey the narrow tail end formed on the pulp web inside the dryer, where the tail threading cord travels outside the edge of the normal web line of the pulp web, which tail end can subsequently be broadened into a normal-width pulp web, the arrangement further comprising means for gripping the tail end in order to bring the tail end inside/between a closing tail threading cord or the like, whereby the gripping means are arranged to function at the normal running speed of the pulp machine.

The invention also relates to a method for threading a pulp web from the press section of a pulp machine to the dryer of the pulp machine, the dryer being provided with a closing tail threading cord or the like, the said tail threading cord conveying the narrow tail end formed earlier on the pulp web inside the dryer, the said tail end being subsequently broadened into a normal-width pulp web, in which method the tail end is conveyed at essentially the normal running speed of the pulp machine between the tail threading cord using means to convey the tail end a desired distance inside/between the closing tail threading cord or the like.

2) Description of Related Art

In a typical pulp machine, from the headbox of the pulp machine is fed pulp onto the wire section, which pulp is dewatered in such a way that the dry matter content of the pulp web is approximately 20%, and after the wire section the pulp web is conveyed through the press section, where the dry matter content is increased to a value of approximately 50%. After the press section, the pulp web is typically dried in an air dryer, in which the pulp web travels through layers that are on top of each other from the top part of the dryer to its bottom part alternately from the forward end to the tail of one layer and from the tail of the next layer to its forward end, etc. The drying layers are formed by means of rows of blow boxes, whereby in each layer, the air nozzles in the blow boxes are directed, for example, towards each other and the pulp web travels on a route between the said air nozzles facing each other. The length of the route travelled by the pulp web in the air dryer is typically within the range from about 500 to 1000 m, depending on the length of the dryer, which is typically about 20 to 50 m, and on the number of layers, which may be, for example, 10 to 30. Typically, the pulp web travels as an open draw from the press section to the dryer section. To facilitate the feeding of the pulp web from the press section to the dryer, a narrow tail end cut on the edge of the pulp web before the press section is used, which is conveyed inside the dryer by means of the closing tail threading cord running adjacent to the drying route, and typically through the entire dryer, before the tail end is broadened to its full web width.

Once the pulp web has been broadened to the normal web width, the use of the tail threading cord is discontinued and the pulp web will travel drawn by the drawing rolls in the dryer as an open draw from the press nip N to the top part of the dryer. The lifting height of the open draw of the pulp web is typically of the order of about 5 m. In a prior art arrangement, the threading of the tail end typically takes place manually, which can be carried out at the normal running speed of the pulp machine only in relatively slow pulp machines having a running speed of, for example, below about 150 m/min. In current pulp machines, where the running speed may exceed about 250 m/min, to be able to convey the tail end manually inside the tail threading cord during the tail bringing stage, the speed of the pulp machine must be kept substantially lower than the normal running speed. Furthermore, this type of manual bringing requires considerable professional skill and includes a risk of injury should one's hand for some reason be left inside the closing tail threading cord. The functioning of a closing tail threading cord is previously known, and one solution for opening and closing a closing tail threading cord inside the tail end to enable feeding is disclosed in FI-patent no. 55882. In connection with the present application, the term "closing tail threading cord or the like" includes, for example, in addition to the closing tail threading cord disclosed in the FI-patent 55882, also tail threading arrangements known as such comprised of endless rope-, chain-, or band-like means, in which the tail threading cord is pressed between two or more rope-, chain-, or band-like means.

The aim of the invention is, therefore, to provide as fully automated a method as possible for threading a pulp web from the press section to the dryer. One solution for conveying the tail end mechanically inside the tail threading cord is disclosed in a previous application FI 981449 by the Applicant of the present application, where, however, one significant problem was considerable lateral shift of the order of 400 mm. The wet end of the pulp web does not withstand lateral "twisting", but will tear easily, whereas it withstands straight pulling by its own weight over several metres. To solve this problem, the arrangement according to the invention for threading a pulp web from the press section to the dryer is characterised in that the arrangement comprises means by which the tail threading cord can be moved inwards from its normal route, towards the pulp web, to travel essentially in the same line with the tail end formed on the edge of the pulp web before the tail end is conveyed inside the tail threading cord, and means by which the tail threading cord and the tail end inside it can be moved back to the normal route located outside the edge of the pulp web before entering the dryer.

BRIEF SUMMARY OF THE INVENTION

The method according to the invention for threading a pulp web from the press section to the dryer is in turn characterised in that in the method, the tail threading cord is moved inwards from its normal route, towards the route of the pulp web, to travel essentially in the same line with the tail end formed on the edge of the pulp web before the tail end is conveyed inside the tail threading cord, and that the tail threading cord and the tail end inside it can be moved back to the normal route located outside the edge of the pulp web before entering the dryer.

Some preferred embodiments of the invention are disclosed in the dependent claims.

BRIEF DESCRIPTION OF THE SEVERAL VIEWS OF THE DRAWINGS

The invention is described in greater detail in the following, with reference to the accompanying drawings, in which:

FIG. 1 shows a diagrammatic side view of one tail threading arrangement according to the invention between the press section 1 and the dryer section 2 of a pulp machine. The pulp web W arrives on a machine felt 8 travelling through the nip N between the press rolls 10 and 11 of the press section 1 and at the start-up stage of the machine travels first down around the guide roll 12 of the machine felt, for example, onto the conveyor belt (not shown) leading to the pulper.

DETAILED DESCRIPTION OF THE INVENTION

Figure 2:
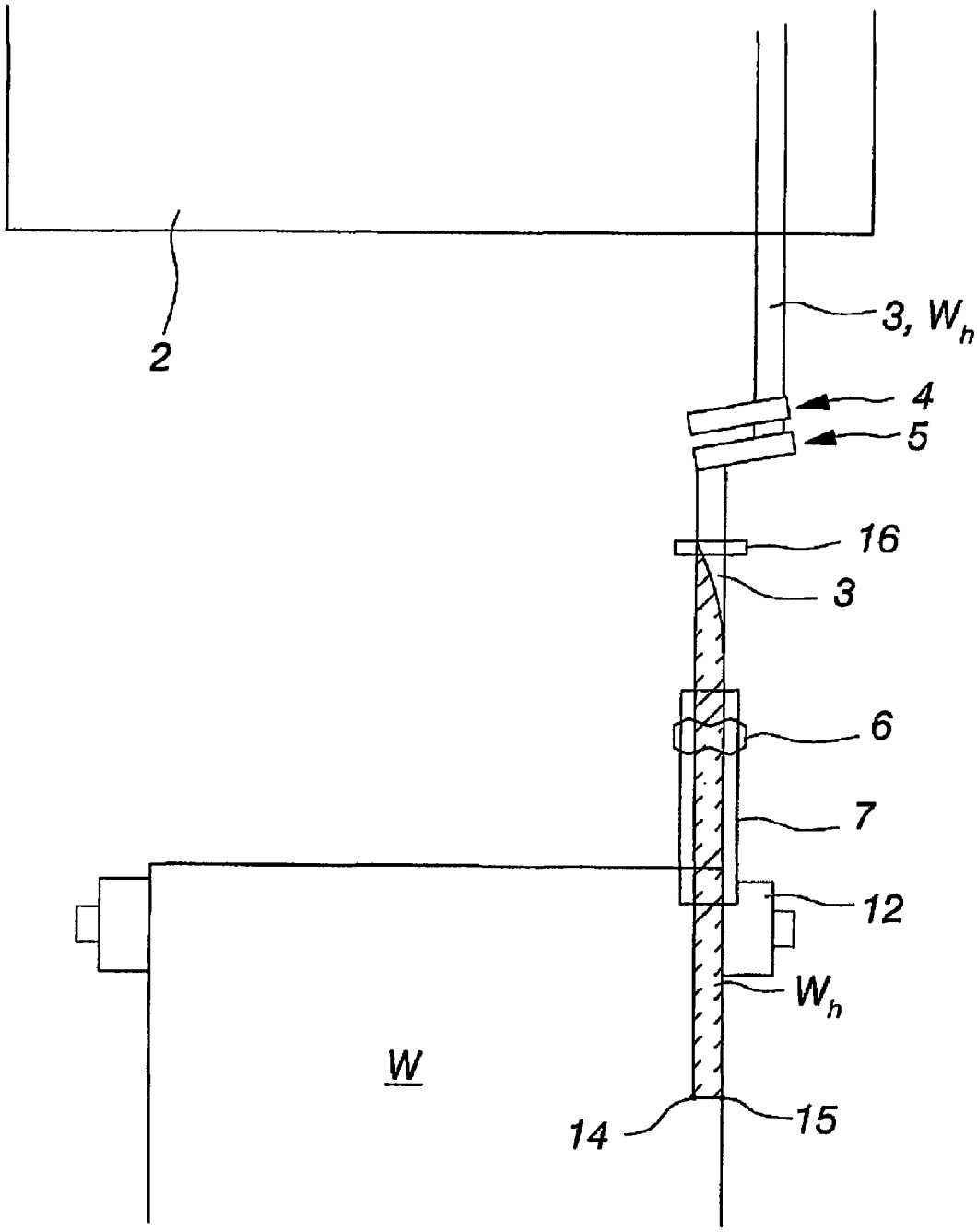
FIG. 2 shows a diagrammatic top view of the arrangement according to the invention.

The tail threading cord 3 advances by means of the required guide and tension rolls through the dryer 2, outside the normal route of the pulp web and comes out through the lower part of the dryer 2 to the tensioning tower 9 of the cord, after which the cord is conveyed to the opening wheels 6, which causes the cord to open in such a way that the tail end $W_h$ can be guided inside the cord. FIG. 2 shows a top view of the pulp web W, from which is cut, by means of a cutter, for example, a water-jet cutter 14, a narrow tail end $W_h$ which is gripped by means of a suction belt device 7 in order to convey the tall end inside the opened tail threading cord 3. Once the tail end has been conveyed inside the tail threading cord 3, a roll or pin means 16 causes the tail threading cord 3 to close, and after this the tail threading cord 3 together with the tail end $W_h$ is taken to the dryer and conveyed the required distance inside it, typically through the entire dryer, after which the tail threading cord is broadened to full width in a manner described below.

In the arrangement according to the invention, between the tensioning tower 9 of the cord and the opening wheels 6 is arranged a first mechanism comprising a first set of transfer wheels 4 by means of which the cord can be guided inwards towards the pulp web W in such a way that the tail threading cord 3 will travel in essentially in the same line with the tail end $W_h$ cut from the edge of the pulp web. As the transfer wheels 4 may serve, for example, two parallel straight wheels or short rolls, which are placed in an inclined position with respect to the cord 3. This arrangement will prevent the formation of side thrusts in the cord or tail end, which would cause the tail end to break.

When tail threading is started, the suction belt device 7, comprising a third mechanism, also referred to herein as a gripping mechanism, grips the tail end $W_h$ cut from the web W and leading to the pulper, thus causing it to break and a new end to be formed, which is conveyed by means of the suction belt device 7 inside the tail threading cord 3, which tail threading cord 3 is then closed and after that the tail threading cord together with the tail end is conveyed by means of a second mechanism comprising a second set of transfer wheels 5 back to the normal route of the tail threading cord located outside the edge of the pulp web. The transfer wheels 5 may be similar to the transfer wheels 4.

The opening wheels 6 and the transfer wheels 5 following it are located lower than a normal web line of a pulp web because they are fixed parts which are located at the edge of the pulp web. The centreline of the opening wheels 6 is preferably at the edge of the web. Once the tail end $W_h$ of the pulp web has been conveyed between the open cord 3 and the cord has been closed, the use of the suction belt device 7 is discontinued and it is turned from its operating position to its standby position, which may be located above and/or on the side of the web W.

Once the tail end $W_h$ has been conveyed far enough inside the dryer, broadening of the tail end to the normal width of the pulp web is begun.

Figure 1:
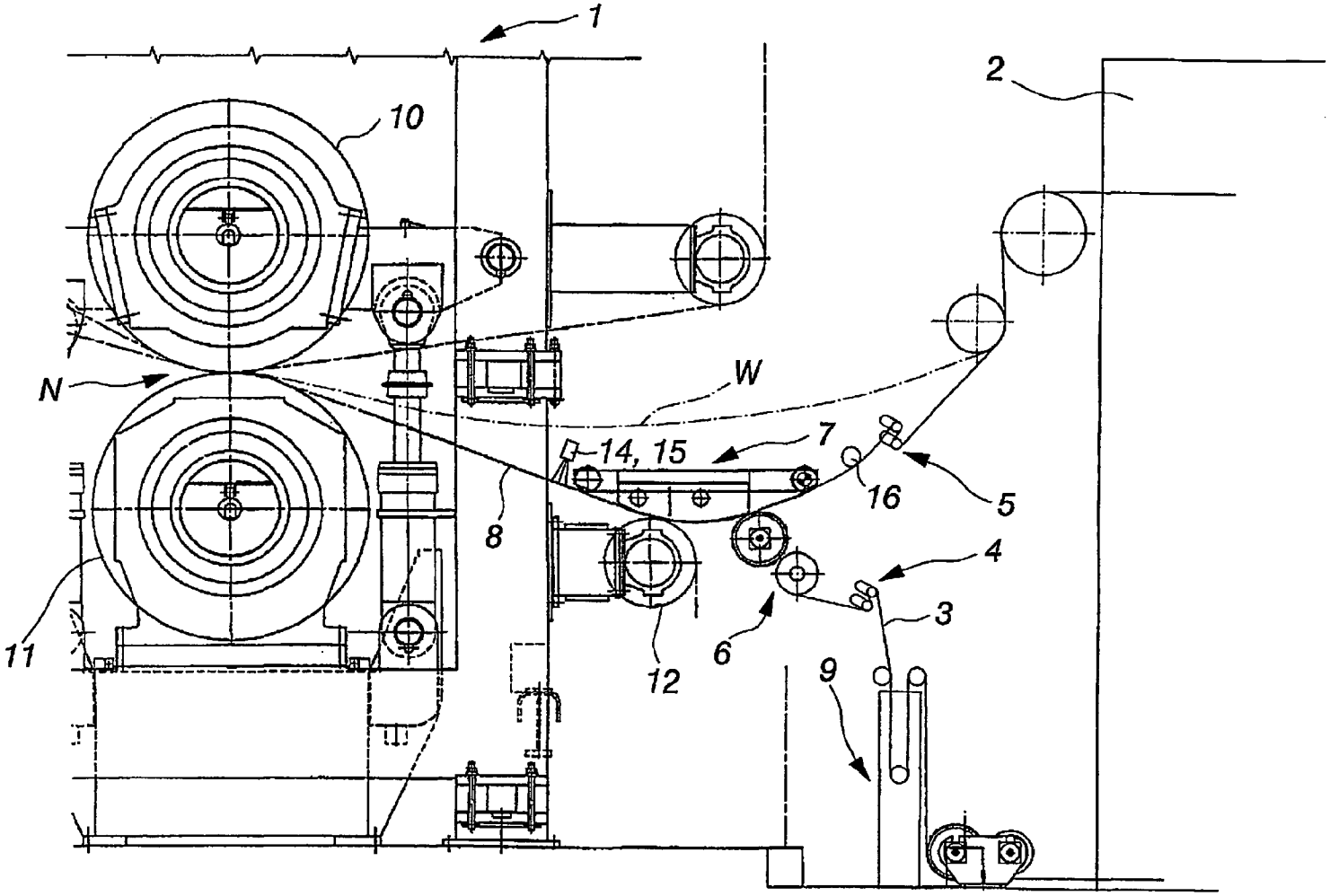
FIG. 1 shows diagrammatically the arrangement according to the invention between the press section and dryer of a pulp machine.
Figure 3:
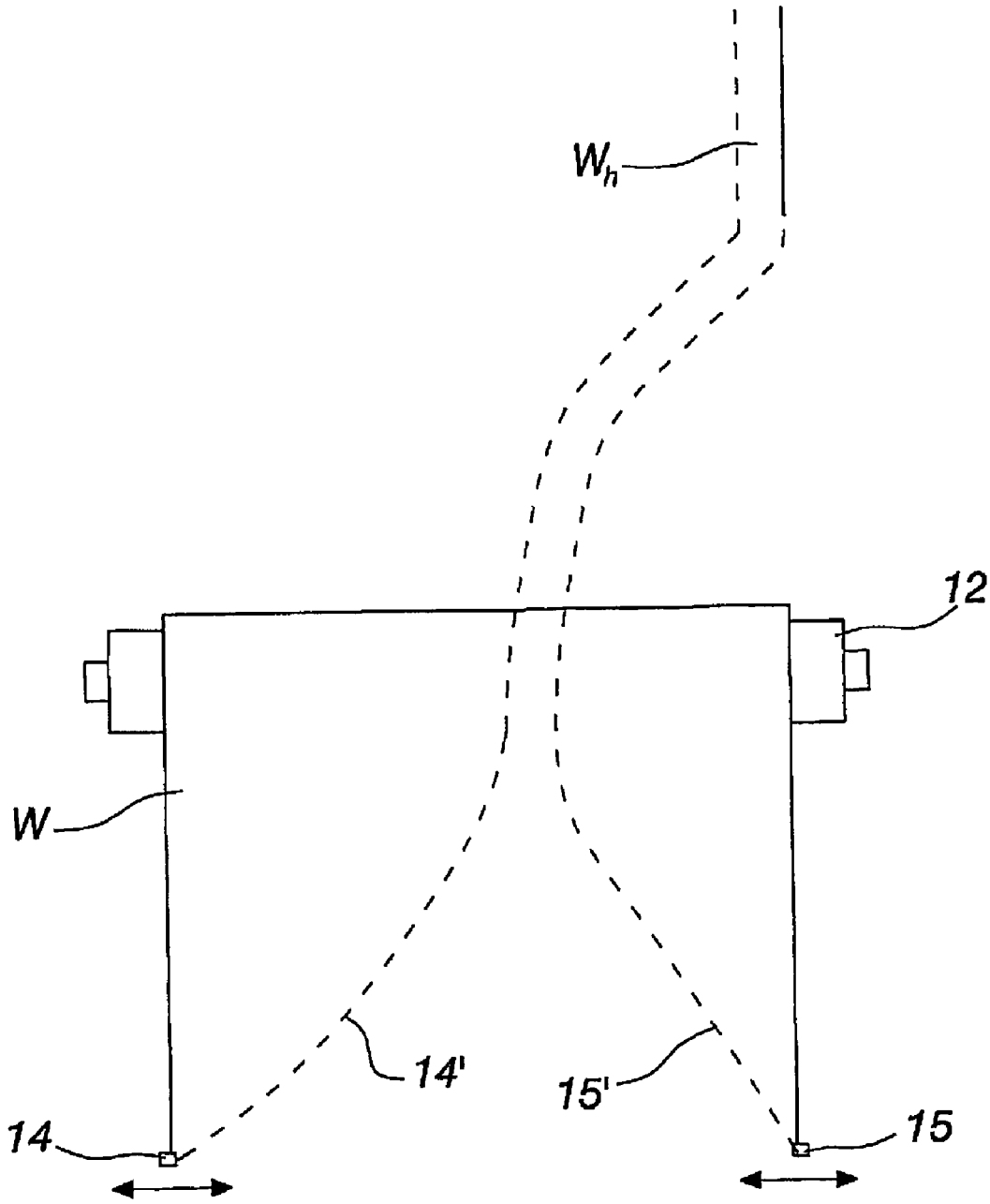
FIG. 3 shows diagrammatically the broadening of the pulp web to normal web width, as takes place according to the invention.

According to the present invention, this may be done in the manner shown diagrammatically in FIG. 3 by using two cutters, for example, water jet cutters 14 and 15, provided in conjunction with the press section. When the tail end $W_h$ is cut, only cutter 14 is in operation to begin with, and when the broadening of the web is begun, cutter 15 is also started and both cutters are first guided simultaneously towards the centreline of the pulp machine. The tail end $W_h$ will then come out from between the cord 3 and by increasing tension at the same time, the tail end will rise closer to the normal web line (in FIG. 1, the pulp web W is shown in its normal web line during running in dotted lines). After this the web W is broadened to its normal width in such a way that the inner cutter 14 continues towards the opposite edge of the pulp web and the outer cutter 15 returns to the edge of the web on the side of the tail threading cord 3. In FIG. 3, the dotted line 14' shows the cutting mark caused by the movement of the cutter 14 across the web W, and dotted line 15' correspondingly shows the cutting mark caused by the cutter 15. The cutters 14 and 15 are shown in FIG. 3 in their positions following the broadening of the web W, where their cutting action is discontinued and cutter 14 returns to its starting position towards cutter 15.

The invention claimed is:

1. An arrangement for threading a pulp web from a press section of a pulp machine to a dryer of the pulp machine in a machine direction, the arrangement comprising a closing tail threading cord arranged to convey a narrow tail end formed on the pulp web to and inside the dryer, where the tail threading cord normally travels outside the edge of the normal web line of the pulp web, which tail end can subsequently be broadened into a normal-width pulp web, the arrangement further comprising a third mechanism for gripping the tail end in order to bring the tail end inside/between the closing tail threading cord, whereby the gripping mechanism is arranged to function at a normal running speed of the pulp machine, the arrangement comprising:

a first mechanism operably engaged with and configured to move the tail threading cord laterally inwards from its normal route in the machine direction, towards the pulp web, such that the tail threading cord travels in a substantially same route in the machine direction as the tail end, whereby the tail end is conveyed inside and received by the tail threading cord; and a second mechanism operably engaged with and configured to move the tail threading cord and the tail end received thereby laterally outward, back to the normal route of the tail threading cord located outside the edge of the pulp web, before the pulp web enters the dryer.

2. An arrangement as claimed in claim 1, wherein each of the first and second mechanisms for laterally moving the tail threading cord are comprised of two parallel straight wheels or short rolls placed in an inclined position with respect to the cord in order to move the cord laterally.

3. An arrangement as claimed in claim 1, wherein the conveying of the tail end inside the tail threading cord is arranged to be automatic.

4. An arrangement as claimed in claim 1, wherein the arrangement comprises a cutter for forming the tail end on the edge of the pulp web in order to convey the tail end inside the tail threading cord, and an additional cutter for changing the location of the tail end in the lateral direction of the web so that the tail end is removed from the tail threading cord and then broadened to normal web width.

5. A method for threading a pulp web from a press section of a pulp machine to a dryer of the pulp machine in a machine direction, the dryer being provided with a closing tail threading cord for conveying a narrow tail end formed on the pulp web inside the dryer, the tail end being subsequently broadened into a normal-width pulp web, the tail end being conveyed at a normal running speed of the pulp machine between the tail threading cord and for a desired distance in the machine direction inside/between the closing tail threading cord, said method comprising:

moving the tail threading cord laterally inwards from its normal route in the machine direction, towards the pulp web, such that the tail threading cord travels in a substantially same route in the machine direction as the tail end, whereby the tail end is conveyed inside and received by the tail threading cord; and moving the tail threading cord and the tail end received thereby laterally outward, back to the normal route of the tail threading cord located outside the edge of the pulp web, before the pulp web enters the dryer.

6. A method as claimed in claim 5, wherein in the method are used two cutters, of which at least one is used to form the tail end on the edge of the web, the tail end being conveyed inside the tail threading cord, and that subsequent to conveying the tail end inside the tail threading cord, both cutters are used to alter the location of the tail end in the lateral direction of the web in such a way that the tail end is removed from the tail threading cord and then broadened to normal web width.

7. A method as claimed in claim 6, wherein for altering the said location of the tail end, both cutters are first conveyed laterally inwards towards the center of the web, whereby the tail end is removed from the cord, after which the cutter disposed farther from the tail threading cord is driven to the opposite edge of the web from the tail end and the cutter disposed closer to the tail threading cord is returned to the edge of the web on the side of the tail threading cord, whereby the web is broadened to its normal running width.

* * * * *